United States Patent [19]

Elmasry et al.

[11] Patent Number: 5,066,559

[45] Date of Patent: Nov. 19, 1991

[54] LIQUID ELECTROPHOTOGRAPHIC TONER

[75] Inventors: Mohamed A. Elmasry, Woodbury; Kevin M. Kidnie, St. Paul, both of Minn.

[73] Assignee: Minnesota Mining and Manufacturing Company, St. Paul, Minn.

[21] Appl. No.: 468,153

[22] Filed: Jan. 22, 1990

[51] Int. Cl.[5] ..... G03G 9/12

[52] U.S. Cl. ..... 430/111; 430/115

[58] Field of Search ..... 430/111, 115

[56] References Cited

U.S. PATENT DOCUMENTS

| | | | |
|---|---|---|---|
| 3,772,199 | 11/1973 | Tamai et al. | 252/62.1 |
| 3,990,980 | 11/1976 | Kosel | 252/62.1 |
| 4,579,803 | 4/1986 | Kato et al. | 430/114 |
| 4,618,557 | 10/1986 | Dan et al. | 430/114 |
| 4,665,002 | 5/1987 | Dan et al. | 430/114 |
| 4,690,881 | 9/1987 | Nagai et al. | 430/114 |
| 4,772,528 | 9/1988 | Larson et al. | 430/115 |
| 4,925,766 | 5/1990 | Elmasry et al. | 430/138 |

FOREIGN PATENT DOCUMENTS 1223343 2/1971 United Kingdom .

*Primary Examiner*—David Welsh
*Assistant Examiner*—S. Rosasco
*Attorney, Agent, or Firm*—Gary L. Griswold; Walter N. Kirn; Gregory A. Evearitt

[57] ABSTRACT

Liquid toners for developing electrophotographic images contain dispersed toner particles which are based on a polymer with multiple characteristics. These particles comprise a thermoplastic resinous core with a $T_g$ below room temperature which is chemically anchored to an amphipathic copolymer steric stabilizer containing covalently attached groups of organic acid containing moieties having pKa's less than 4.5 which in turn are chemically bonded to metal soap containing compounds derived from organic acids having a pKa greater than 4.5. The toner particles so formed have advantageous properties of high charge/mass, and good charge and dispersion stability.

30 Claims, No Drawings

LIQUID ELECTROPHOTOGRAPHIC TONER

BACKGROUND OF THE INVENTION

1. Field of Invention

The invention relates to multicolor toned electrophotographic images in which high quality colorimetric and sharpness properties are required, and are obtained using liquid toners. In particular, it relates to processes of development where two or more toner images are superimposed and then transferred together to a receptor surface. Applications include color half-tone proofing.

2. Background of the Art

Metcalfe & Wright (U.S. Pat. No. 2,907,674) recommended the use of liquid toners for superimposed color images as opposed to the earlier dry toners. These liquid toners comprised a carrier liquid which was of high resistivity, e.g., $10^9$ ohm.cm or more, colorant particles dispersed in the liquid, and preferably, an additive intended to enhance the charge carried by the colorant particles. Matkan (U.S. Pat. No. 3,337,340) disclosed that when one toner is deposited first, it may be sufficiently conductive to interfere with a succeeding charging step; he claimed the use of insulative resins (resistivity greater than $10^{10}$ ohm.cm) of low dielectric constant (less than 3.5) covering each colorant particle. York (U.S. Pat. No. 3,135,695) disclosed toner particles stably dispersed in an insulating aliphatic liquid, the toner particles comprising a charged colorant core encapsulated by a binder of an aromatic soluble resin treated with a small quantity of an aryl-alkyl material. The use of explicit dispersant additives to the toner dispersion is disclosed in U.S. Pat. No. 3,669,886.

The use of copolymers comprising monomers selected from a variety of materials such as derivatives of maleic acid, succinic acid, diisobutylene, benzoic acid, fumaric acid, acrylic acid, methacrylic acid and the like as charge control agents in toners is known in the art (U.S. Pat. Nos. 3,753,760; 3,772,199; 4,062,789; 4,579,803; 4,634,651; 4,665,002; 4,690,881; 4,764,447; and GB 1,223,343). For various reasons, however, the use of the copolymers tend to be limited in the foregoing patents as charge control agents.

The use of metal soaps as charge control and stabilizing additives to liquid toners is disclosed in many patents (e.g., U.S. Pat. Nos. 3,900,412; 3,417,019; 3,779,924; 3,788,995; and 4,062,789). On the other hand, concern is expressed and cures offered for the inefficient action experienced when charge control or other charged additives migrate from the toner particles into the carrier liquid (U.S. Pat. Nos. 3,900,413; 3,954,640; 3,977,983; 4,081,391; and 4,264,699). A British patent (GB 2,023,860) discloses centrifuging the toner particles out of a liquid toner and redispersing them in fresh liquid as a way of reducing conductivity in the liquid itself.

In several patents the idea is advanced that the level of free charge within the liquid toner as a function of the mass of toner particles is important to the efficiency of the developing process (U.S. Pat. Nos. 4,547,449 and 4,606,989). In U.S. Pat. No. 4,525,446 the aging of the toner was measured by the charge present and related it generally to the zeta potential of the individual particles. A related patent of the same assignee, U.S. Pat. No. 4,564,574, discloses that charge director salts were chelated onto the polymer binder by specially incorporated moieties on the polymer. It further discloses measured values of zeta potential on toner particles. Values of 33 mV and 26.2 mV with particle diameters of 250 nm and 400 nm are given. The disclosed objective of that patent is improved stability of the liquid toner. Attachment of the chelated salts directly to the polymer chain necessitates the presence of the charge in a random orientation off of the polymer. The charge would be generally distributed throughout the bulk and surface of the polymer. Finally in U.S. Pat. No. 4,155,862 the charge per unit mass of the toner was related to difficulties experienced in the earlier art in superimposing several layers of different colored toners.

This latter problem was approached in a different way in U.S. Pat. No. 4,275,136 where adhesion of one toner layer to another was enhanced by an aluminum or zinc hydroxide additive on the surface of the toner particles.

The advantages of using binders comprising organosols (sometimes described as amphipathic particles) are disclosed in patents assigned to Philip A. Hunt Chemical Corp. (U.S. Pat. Nos. 3,753,760, 3,900,412, and 3,991,226). Amongst the advantages is a substantial improvement in the dispersion stability of the liquid toner. The organosol is sterically stabilized with a graft copolymer stabilizer, the anchoring groups for which are introduced by the esterification reaction of an epoxy (glycidyl) functional group with an ethylenically unsaturated carboxylic acid. The catalyst used for the esterification is lauryldimethylamine or any tertiary amine. A similar treatment is found in U.S. Pat. No. 4,618,557 assigned to Fuji Photo Film except that they claim a longer linking chain between the main polymer and the unsaturated bond of the stabilizing moiety. Their comparative examples with the Hunt toners show that Fuji has improved the poor image quality found in the Hunt toners due to image spread, and they ascribe the improvement to the use of the longer linking chains.

In all of the aforementioned Hunt and the Fuji patents, however, the charge director compounds, when used, are only physically adsorbed to the toner particles. Therefore, it is possible that the charge director compounds could be desorbed from the toner particles and migrate back into the carrier liquid and thereby substantially lower the effectiveness of the toner.

Diameters of toner particles in liquid toners vary from a range of 2.5 to 25.0 microns in U.S. Pat. No. 3,900,412 to values in the sub-micron range in U.S. Pat. Nos. 4,032,463, 4,081,391, and 4,525,446, and are even smaller in a paper by Muller et al, "Research into the Electrokinetic Properties of Electrographic Liquid Developers", V. M. Muller et al., IEEE Transactions on Industry Applications, vol IA-16, pages 771–776 (1980). It is stated in U.S. Pat. No. 4,032,463 that the prior art makes it clear that sizes in the range 0.1 to 0.3 microns are not preferred because they give low image densities.

Liquid toners that provide developed images which rapidly self-fix to a smooth surface at room temperature after removal of the carrier liquid are disclosed in U.S. Pat. Nos. 4,480,022 and 4,507,377. These toner images are said to have higher adhesion to the substrate and to be less liable to crack.

SUMMARY OF THE INVENTION

This invention describes a color liquid developer based on a polymer dispersion in a non-polar carrier liquid which combines a number of important toner characteristics in a single molecule. The dispersed particles comprise a thermoplastic resinous core which is chemically anchored to a graft copolymer steric stabilizer. Such systems are commonly called organosols. This invention discloses how such organosol systems can be prepared without introducing unwanted ionic species which are soluble in the carrier liquid which are obstructive to an efficient toner development process. The core part of the particle has a $T_g$ which is preferably below 25° C. so that the particles can deform and coalesce into a resinous film at room temperature after being electrophoretically deposited onto a photoconductive substrate. Such film forming particles have been found to be useful for successive overlay of colors with greater than 90% trapping. As a result, a single transfer imaging process has been achieved.

The stabilizer part of the particle of this invention, which is the soluble component in the dispersion medium, is an amphipathic copolymer containing covalently attached moieties which contain organic acid groups having a pka of less than 4.5. The function of these organic acid groups is to form sufficiently strong chemical bonds with metal soap compounds derived from organic acids having a pka of greater than 4.5 so that an anion exchange reaction occurs between the organic acid groups (pKa less than 4.5) which emanate from the amphiphatic copolymer and the acid groups (pKa greater than 4.5) contained by the metal soap compounds whereby the charge directing metal is chemically bonded to the organic acid (pKa less than 4.5) so that little or no subsequent desorption of the charge controlling compounds from the toner particles occurs.

In the compounding of the toner developer liquid according to this invention, the finely powdered colorant material is mixed with the polymer dispersion in the carrier liquid (organosol) described above and subjected to a further dispersion process with a high speed mixer (e.g. Silverson TM mixer) to give a stable mixture. It is believed that the organosol particles agglomerate around each individual colorant particle to give stable dispersions of small particle size, the organosol bringing to the combined particle its own properties of charge stability, dispersion stability, and film-forming properties.

In summary, the toners of the present invention comprise a pigment particle having on its exterior surface polymer particles which are usually of smaller average dimensions than said pigment particle, said polymer particles having a positive charge carrying metal soap compounds derived from an organic acid with a pKa greater than 4.5 chemically bonded to the surface of the polymeric particles by way of organic acid containing moieties which have a pka less than 4.5. Polymeric particles in the practice of the present invention are defined as distinct volumes of liquid, gel, or solid material and are inclusive of globules, droplets etc. which may be produced by any of the various known technique such as latex, hydrosol or organosol manufacturing.

Comparison to the Prior Art

In the toners disclosed in the Hunt patents (U.S. Pat. Nos. 3,753,760, 3,900,412, and 3,991,226), the presence of a few parts per million of a tertiary amine in the liquid toner medium produces toners with very high conductivity especially when the toner is charged with a metal soap. This causes flow of the toner during imaging which in turn degrades the image. The high conductivity is derived from the protonation of the tertiary amine groups by the unsaturated carboxylic acid groups, yielding ionic carriers in the liquid. Another problem associated with the use of tertiary amines is the high background in the non-imaged areas which is the result of negatively charged or non-charged particles. The esterification reaction of the glycidyl groups and the carboxylic groups usually does not go to completion under the reaction conditions for making the organosol. The examples in these patents show that between 25% to 50% of the carboxylic acid groups could be esterified. In other words, about 50% to 75% of the carboxylic acid still remain in the dispersion medium. During the dispersion polymerization reaction for making the latex, the unreacted unsaturated acid can copolymerize with either the core part of the particle or the stabilizer polymer or both at the same time. The tertiary amine also may become attached onto the polymer particle by hydrogen abstraction. The presence of carboxylic acid on the particle and tertiary amine in the liquid medium or on the particle would be expected to result in the formation of carboxylic anions on the particle which is a good source for a negative charge.

These problems have been eliminated from the toner of the present invention through the use of a suitable catalyst other than tertiary amines or the use of other anchoring adducts that can be catalyzed with catalysts other than tertiary amines.

U.S. Pat. No. 4,618,557 draws attention to the poor performance of the prior art (Hunt) toners and relates it to the number of carbon atoms in the linking chain. In the present invention it has been found that the use of a tertiary amine catalyst for attaching an unsaturated group to the main chain of the stabilizing resin via linking groups is the main reason for the poor performance of Hunt's liquid developers. It is believed therefore that the liquid developers of U.S. Pat. No. 4,618,557 showed better quality images compared with Hunt's because they do not use a tertiary amine catalyst, rather than the claimed use of long linking groups. However, that patent failed to disclose anything related to the present invention.

Toners according to the present invention are superior to the toners of U.S. Pat. No. 4,618,557 for these reasons:

a) U.S. Pat. No. 4,618,557 uses zirconium naphthenate as the charge director for its liquid toners. The metal cation is physically adsorbed onto the dispersed particles. This method usually results in a charge decay with time due to the gradual desorption of the metal soap from the particles. The toners according to the present invention do not suffer a charge decay because they are charged with metal charge controlling groups chemically attached to the resin particles.

b) U.S. Pat. No. 4,618,557 uses mercury acetate, tetrabutoxy titanium or sulfuric acid as catalyts for the anchoring reaction. Some of the substances are toxic (such as mercury acetate) and must be removed from the toner. However, the patent uses subsequent steps to remove the catalysts by precipitation from a non-solvent such as acetonitrile or methanol. These solvents may be trapped in the stabilizing polymer and are very difficult to remove. The present invention selectively chooses catalysts and reactants so that there is no need for the purification step.

U.S. Pat. No. 4,579,803 is based on a copolymer comprising a monomer of half alkylamide of maleic acid. The carboxylic acid group is neutralized with organic base or metal cation or reacted to form a quaternary salt. The polymerization of a half alkylamide of maleic acid would produce a polymer with repeated units of half alkylamide of succinic acid. All the counterions of the metal atom are derived from carboxylic acid groups of the same pka value.

U.S. Pat. No. 4,062,789 uses a copolymer of a half alkyamide of maleic acid and diisobutylene which is similar to U.S. Pat. No. 4,579,803 except for using an organic acid additive to prevent the degradation of the charge controlling agent. The additive may be chosen from benzoic acid, succinic acid, chloroacetic acid and the higher aliphatic acids. Although the pka values of some of these acid additives in water are less than 4.3, they are not incorporated in the polymer by a chemical reaction to form covalent bonds.

U.S. Pat. No. 3,772,199 uses a copolymer of a half alkylamide of maleic acid and diisobutylene with a soluble organic base of 1-hydroxyalkyl-2-higher alkyl-2-imidazoline as the charge controlling agent. The patent did not mention the use of metal salts with these polymers.

U.S. Pat. No. 4,665,002 uses polymeric grains of uniform particle size to improve the performance of the toner particles. The resin dispersion of the reference is prepared by polymerizing a monomer A which is soluble in the liquid carrier but becomes insoluble on polymerization in the presence of a dispersion stabilizing resin which is soluble in the liquid carrier. The stabilizer resin is a copolymer of formulas I and II shown below.

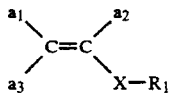

(I)

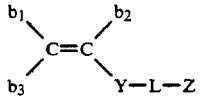

(II)

wherein:

X, Y may be a hetero atom, —O—, —S—, CO, $—CO_2—$, $SO_2$, $—CO_2—$, —OCO—, —CONH—, $—CNR_2$; $R_2$=—NH—CO—NH—

L=$—(CH_2)n—$; n=1-6

Z=—COOH, epoxy, —COCl, $NH_2$, —NCO, —NHR $R_1$=$—(CH_2)n—CH_3$; n=4-19

Compound I is the solubilizing component of the stabilizing polymer and compound II is used for grafting unsaturated groups for anchoring the insoluble component of monomer A. When Z is COOH it would be reacted with a glycidyl group or amino group to provide the anchoring components. Accordingly, the stabilizing polymer does not have free carboxylic acid groups. Monomer A is selected from itaconic anhydride, maleic anhydride or a compound of formula III as shown below.

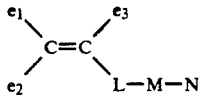

(III)

wherein:

L=$—CH_2—$, $—CH_2—CH_2—$

M=$—CO_2—$, —OCO—, —O—

N=a hydrocarbyl group

Monomer A is used for making the insoluble part of the particle (core). The combination of L,M,N of a compound of formula III would not produce a compound with a terminal carboxyl group. Furthermore, the incorporated acid anhydrides in the insoluble core are not used in subsequent reactions for generating free acid groups that can exchange with a metal soap.

U.S. Pat. No. 4,690,881 uses pigment particles coated with humic acid, humates or humic acid derivatives and a copolymer of ethylene-vinylacetate. The coated particles are further dispersed in a resinous copolymer. Examples 3 and 4 of that patent show the incorporation of itaconic acid and fumaric acid as part of the resinous copolymer. However, the reference patent does not use metal soaps as the charge controlling agent with these resinous copolymers. The present invention is based on an ion exchange of carboxylic acid groups with a pka value of less than 4.5 with metal soaps having carboxylic anions derived from a fatty acid with a pka value greater than 4.5.

U.S. Pat. No. 4,618,557 is based on the same chemistry of U.S. Pat. No. 4,665,002 except that the terminal —COOH of the stabilizer precursor is reacted with vinylacetate in the presence of a catalyst to produce a graft copolymer stabilizer. Again, there is no available —COOH group attached to the stabilizer polymer to exchange with a metal soap.

U.S. Pat. No. 4,634,651 uses a non-aqueous resin dispersion prepared by the suspension polymerization of a monomer of an unsaturated ester of a fatty alcohol and a monomer of the formula below.

$$[CH_2{=}C(R_1)—COO(CH_2CH_2)n—OOCOCH{=}CH—COO]_m R_2$$

$R_2$=H, Na, K, Li, Ca, Al, Co, Mn, Mg

The above monomer has at lest two unsaturated sites. The two double bonds participate equally in the free radical polymerization leading to highly cross-linked polymeric particles. The resulting suspended particles are completely insoluble in the carrier liquid. As a result, the carboxylic acid groups are not available in the carrier liquid to exchange with a metal soap. Furthermore, all the counter ions of the metal atom are part of the insoluble suspended polymer particle. Therefore, the dissociation of the metal cation or the carboxylate anions would be negligible. The carboxylic acid groups of the present invention are part of the soluble component of the dispersed particle and therefore, they can easily exchange with metal soaps derived from fatty acids and the undisplaced carboxylic anions of the metal soap retain their solubility in the carrier liquid to provide a high positive charge on the particle.

Examples 3, 4 and 6 of U.S. Pat. No. 4,634,651 show the polymer particles as a negatively charged polymer and examples 5 and 7 show that the polymer particles are positively charged. The electrodeposition results of these examples indicate that the polarity of these toners is unpredictable. The resinous salts of the present invention produce only positively charged liquid developers. In the present invention the metal cation bears two types of organic acid anions; one is derived from a soluble carboxylate anion of a fatty acid with a pka value higher than the pka value of the other insoluble carboxylic anion which is attached to the polymeric particle.

In U.S. Pat. No. 4,634,651 all the anions attached to the metal cation are of one type and are derived from an insoluble polymeric acid groups. There is no differential degree of dissociation.

Conventional commercial liquid toners constitute a dispersion of pigments or dyes in a hydrocarbon liquid together with a binder and charge control agent. The binder may be a soluble resinous substance or insoluble polymer dispersion in the liquid system. The charge control agent is usually a soap of a heavy metal for positive toners or an oligomer containing amine groups such as OLOA for negative toners. Examples of these metal soaps are: Al, Zn, Cr, and Ca salts of 3,5-diisopropylsalicylic acid; and Al, Cr, Zn, Ca, Co, Fe, Mn, Va, and Sn salts of a fatty acid such as octanoic acid. Typically, a very small quantity, from 0.01–0.1% wt/volume, of the charge control agent is used in the liquid toner. However, conductivity and mobility measurements of toners charged with any of the above metal soaps showed a decrease in the charge/mass ratio as derived from conductivity measurements within a period of 1–3 weeks. For example, toners made of quinacridone pigment, stabilized with a polymer dispersion of polyvinylacetate in Isopar TM G and charged with Al(3,5-diisopropylsalicylate)$_3$ showed a conductivity of $3\times10^{-11}$ (ohm.cm)$^{-1}$ when freshly diluted with Isopar TM G to a concentration of 0.3 weight %. Upon standing for two weeks the conductivity dropped to $0.2\times10^{-11}$ (ohm.cm)$^{-1}$. Also, this toner would not overlay another cyan toner of the same formulation.

Liquid toners of the conventional art are not therefore suitable for use in the production of high quality digital imaging systems for color proofing. One of the major problems associated with these toners is the flow of the toner during imaging which results in the distortion of the produced images. Another problem is the desorption of the charge-director, as well as the resinous binder, with time. Finally, the commercial toners are not suitable for use in multi-color overlay printing by a single transfer process.

DETAILED DESCRIPTION OF THE INVENTION

The present invention provides liquid electrophotographic developers comprising an electrically insulating carrier liquid having a resistivity greater than $10^{11}$ ohm-cm and a dielectric constant of less than 3.5, a colorant (pigment), and a charge controlling resinous polymer having chemically attached moieties containing organic acid groups with a pka value less than 4.5 capable of displacing at least one anion of an organic salt by ion exchange. The cation of the salt is derived from a metal atom with a valency greater than 1 and the anions are derived from an acid compound with a measured pka value in water of greater than 4.5. The preferred metal salts for use with this invention are selected from those which have good solubility in non-polar solvents such as the carrier liquid and which are derived from organic fatty acids with pka values greater than 4.5 and preferably in the range from 4.6–4.9.

The acid groups of the resinous polymer are selected from ethylenically unsaturated acid compounds with pka values of less than 4.5 and preferably from −1 to 4.25 and having low solubility in non-polar solvents. The charge controlling resinous polymer is prepared by mixing the resinous polymer which contains the pendant acid groups with a metal soap in a non-polar solvent such as the carrier liquid. Upon mixing the two components, an ion exchange occurs by the displacement of at least one anion from the metal salt by at least one anion from the pendant acid compound of the resinous polymer thus forming a polymeric salt having two types of anions. One type is derived from the soluble metal salt and the other type is derived from the polymeric salt having two types of anions. The differential dissociation of the two types of anions in the carrier liquid solvent produces a polymeric resin salt wherein the metal cation is bound to the polymeric moiety and is dissociated from the soluble non-polymeric anions which are derived from the metal salt. The incorporated metal cations impart a permanent positive charge on the resinous polymeric particles.

It has been found that liquid toners formulated from a colorant and a polymer dispersion in a non-polar carrier liquid, wherein metal soap groups are chemically bound to the polymeric moiety of the particles through an anion exchange reaction, provide high quality images for color proofing. The toners of the present invention may be characterized by the following properties:

1. There is charging of the dispersed particles with a charge director not subject to desorption from the particles.
2. The polymeric latex particles provide fixing by film-forming at ambient temperature and thereby facilitate overprinting.
3. Dispersed particles are present in the toners which are stable to sedimentation.
4. The toner displays high electrical mobility.
5. High optical density is provided by the toner in the final image, and the toner (in particulate form) also displays high optical density.
6. A high proportion of conductivity is derived from the toner particles themselves as opposed to spurious ionic species.

This invention provides new toners which alleviates many of the defects of conventional toners.

The component parts of the toner particles are a core which is insoluble in the carrier liquid, a stabilizer which contains solubilizing components and pendant moieties containing organic acid groups with pka's less than 4.5, a charge director metal soap compound having a pka of greater than 4.5 which is chemically bonded to the pendant organic acid groups, and the colorant. These will be described below in detail.

The Core

This is the disperse phase of the polymer dispersion. It is made of a thermoplastic latex polymer with a $T_g$ preferably less than 25° C. and is insoluble or substantially insoluble in the carrier liquid of the liquid toner. The core polymer is made in situ by copolymerization with the stabilizer monomer. As used herein, the term "substantially insoluble" refers to thermoplastic latex polymeric particles which although they may have some minor degree of solubility in the carrier liquid, still form dispersions in the carrier liquid as opposed to solutions, the latter situation of which is outside the scope of this invention. Examples of monomers suitable for the core are well known to those skilled in the art and include ethylacrylate, methylacrylate, and vinylacetate. Substantially insoluble particles of the latex will remain as a dispersion without dissolving (more than 25% by weight) for a period of six months in the dispersant in a particle/dispersant ratio of 1:1.

The reason for using a latex polymer having a $T_g$ preferably less than 25° C. is that such a latex can coalesce into a resinous film at room temperature. According to this invention, it has been found that the overprinting capability of a toner is related to the ability of the latex polymer particles to deform and coalesce into a resinous film during the air drying cycle of the electrophoretically deposited toner particles. The coalescent particles permit the electrostatic latent image to discharge during the imaging cycle so another image can be overprinted. On the other hand, non-coalescent particles of the prior art retain their shape even after being air dried on the photoreceptor. The points of contact are then few compared to a homogeneous or continuous film-forming latex, and as a result, some of the charges are retained on the unfused particles, repelling the next toner. Furthermore, a toner layer made of a latex having a core with a $T_g$ greater than 25° C. may be made to coalesce into a film at room temperature if the stabilizer/core ratio is high enough. Thus the choice of stabilizer/(core+stabilizer) ratios in the range of 20 wt. % to 80 wt. % can give coalescence at room temperature with core $T_g$ values in a corresponding range 25° C. to 105° C. With a core $T_g$ less than 25° C., the preferred range of stabilizer/(core+stabilizer) ratio is 10 to 40 wt. %.

Color liquid toners made according to this invention, on development, form transparent films which transmit incident light, consequently allowing the photoconductor layer to discharge, while non-coalescent particles scatter a portion of the incident light. Non-coalesced toner particles therefore result in the decreasing of the sensitivity of the photoconductor to subsequent exposures and thus there is interference with the overprinted image.

The toners of the present invention have low $T_g$ values with respect to most available toner materials. This enables the toners of the present invention to form films at room temperature. It is not necessary for any specific drying procedures or heating elements to be present in the apparatus. Normal room temperature (19°-20° C.) is sufficient to enable film forming and the ambient internal temperatures of the apparatus during operation, which tends to be at a higher temperature (e.g., 25°-40° C.) even without specific heating elements, is sufficient to cause the toner or allow the toner to form a film. It is therefore possible to have the apparatus operate at an internal temperature of 40° C. or less at the toning station and immediately thereafter where a fusing operation would ordinarily be located.

The Stabilizer

This is a copolymer prepared by the polymerization reaction of at least two comonomers. These comonomers may be selected from those containing anchoring groups, organic acid groups and solubilizing groups. The anchoring groups are further reacted with functional groups of an ethylenically unsaturated compound to form a graft copolymer stabilizer. The ethylenically unsaturated moieties of the anchoring groups can then be used in subsequent copolymerization reactions with the core monomers in organic media to provide a stable polymer dispersion. The prepared stabilizer consists mainly of two polymeric components which provide one polymeric component soluble in the continuous phase and another component insoluble in the continuous phase. The soluble component constitutes the major proportion of the stabilizer. Its function is to provide a lyophilic layer completely covering the surface of the particles. It is responsible for the stabilization of the dispersion against flocculation, by preventing particles from approaching each other so that a sterically-stabilized colloidal dispersion is achieved. The anchoring and the organic acid groups constitute the insoluble component and they represent the minor proportion of the dispersant. The function of the anchoring groups is to provide a covalent link between the core part of the particle and the soluble component of the steric stabilizer. The function of the organic acid groups is to displace at least one anion from a metal salt to impart a permanent positive charge on the particles.

Comonomers for Stabilizer Containing Preferred Functional Groups

1. Monomers containing anchoring groups:

a) adducts of alkenylazlactone comonomers with an unsaturated nucleophile containing hydroxy, amino, or mercaptan groups. Examples are:

2-hydroxyethylmethacrylate
3-hydroxypropylmethacrylate
2-hydroxyethylacrylate
pentaerythritol triacrylate
4-hyroxybutylvinylether
9-octadecen-1-ol
cinnamyl alcohol
allyl mercaptan
methallylamine The azlactone can in general be a 2-alkenyl-4,4-dialkylazlactone of the following structure

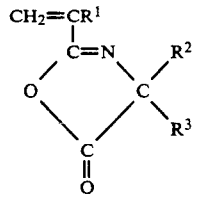

where $R^1$=H, or $C_1$ to $C_5$ alkyl, preferably $C_1$, $R^2$ and $R^3$ are independently lower $C_1$ to $C_8$ b) adducts of glycidylmethacrylate comonomers with acrylic acid or methacrylic acid.

c) allylmethacrylate.

2. Examples of organic acid groups with pka values of less than 4.5 and which are contained in organic moieties which are pendant from the stabilizer and which are chemically bonded to an atom, such as carbon or nitrogen, contained in the nuclei of the stabilizer include, but are not limited to, the organic acid functional groups which are represented by the formulas given below:

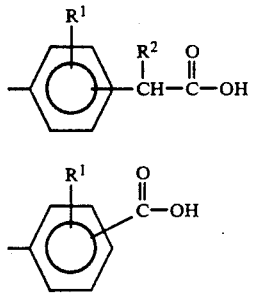

-continued

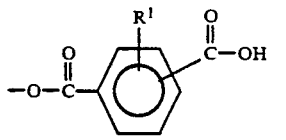

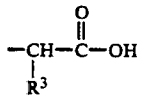

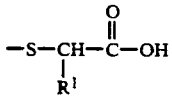

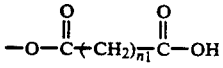

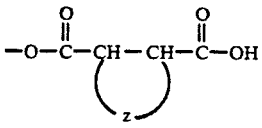

wherein $R_1$ and $R_2$ each individually represent hydrogen, alkyl, halogen, hydroxy, alkoxy, nitrile, amido, carboxyl, nitro, thionyl, phenoxy, sulfo, heterocyclic, sulfenyl, mercapto or carbonyl;

$R_3$ is an electron withdrawing group selected from nitro, nitrile, halogen, and carbonyl;

$n_1$ is an integer from 1–3; and z is $-(CH_2)_{n2}-$ $n_2$ is an integer from 1–5.

Most preferred are:

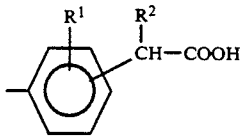

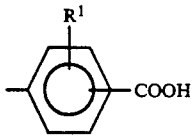

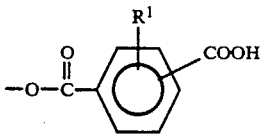

wherein $R_1$ and $R_2$ are individually either hydrogen, methyl, or hydroxy.

Non-limiting examples of monomers which are pendant from the stabilizer and which contain organic acid groups having a pKa of less than 4.5 are as follows:

itaconic acid
4-vinylbenzoic acid
2-methacryloyloxyethyl hydrogen phthalate
mono-(2-methacryloyloxyethyl)-succinic acid
2-sulfoethylmethacrylate
4-methacrylamidobenzoic acid
sulfoethylmethacrylamide 3. Monomers or polymers containing solubilizing groups.

Examples are lauryl methacrylate, octadecyl methacrylate, 2-ethylhexylacrylate, poly(12-hydroxystearic acid), PS 429-Petrarch Systems, Inc. (polydimethylsiloxane with 0.5–0.6 mole % methacryloxypropylmethyl groups, trimethylsiloxy terminated).

Adduct Reactions

Exemplary reactions using these reactants to form the stabilizer are as follows:

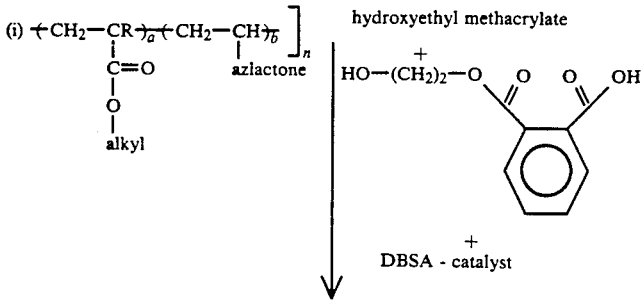

-continued

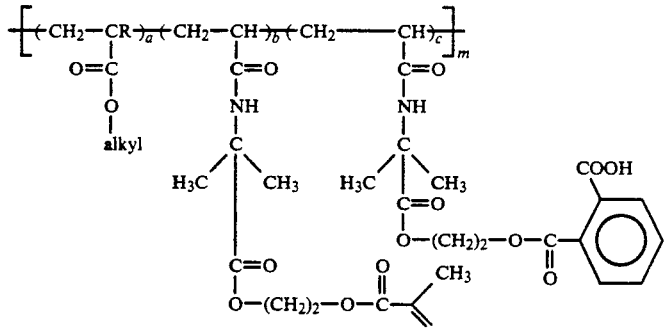

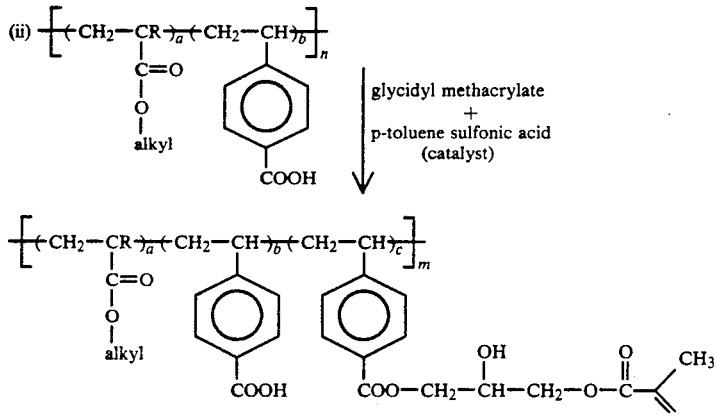

The adduct reaction with azlactone may be exemplified as follows:

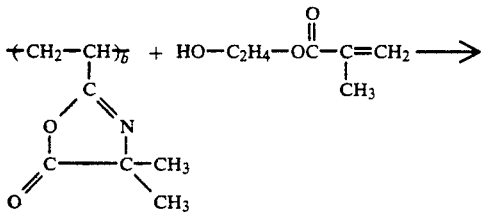

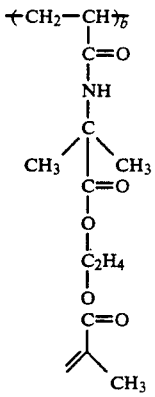

Catalysts

In this invention the preparation of the copolymeric stabilizer and subsequently the dispersed copolymer of the core plus the stabilizer is carried out under conditions using catalysts which do not result in unwanted ionic species in the carrier liquid. Generally, acidic catalysts are employed. Examples of suitable catalysts which can be used are:

- stearyl acid phosphate
- methane sulfonic acid
- substituted or unsubstituted p-toluene sulfonic acids
- dibutyl tin oxide
- a calcium soap e.g., naphthenate, octanoate 2-ethylhexanoate
- a chromium soap e.g., naphtenate, octanoate,
- triphenylphosphine
- triphenylantimony
- dibutyl phosphate For anchoring allylmethacrylate the preferred catalyst is a free radical peroxide initiator such as benzoyl peroxide.

The Metal Soaps

The metal soaps used as charge directors should be derived from metals with a valency greater than 1 and an organic acid compound with a pka value of greater than 4.5. The metal salt must be completely soluble in the carrier liquid to react with the pendant acid groups of the stabilizer. Preferred metal soaps include salts of a fatty acid with a metal chosen from the group of Al, Ca, Co, Cr, Fe, Zn, and Zr. An example of a preferred metal soap is zirconium neodecanoate (obtained from Mooney Co., with a metal content of 12% by weight).

Counter Ion Exchange with Metal Soaps

The reaction of the resin dispersion containing acid groups is shown in the formula below, using a stabilizer containing pendant benzoic acid groups as a representative example.

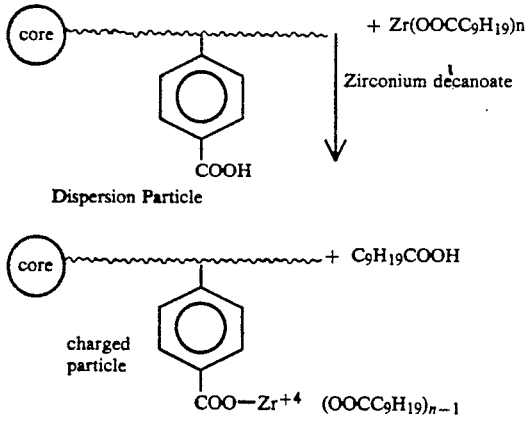

n represents 2, 3 or 4.

Polymer dispersions having pendant acid groups attached to the soluble polymeric component of the particle, having been found to react with soaps of heavy metal in aliphatic hydrocarbon liquids to form polymeric metal salts which are chemically bonded on the surface of the dispersed particles.

Colorants

A wide range of pigments and dyes may be used. The only criteria is that they are insoluble in the carrier liquid and are capable of being dispersed at a particle size below about a micron in diameter. Examples of preferred pigments include:

Sunfast magenta
Sunfast blue (1282)
Benzidine yellow (All Sun Co.)
Quinacridone
Carbon black (Raven 1250)
Carbon black (Regal 300)
Perylene Green

Liquid Toner Conductivities

Conductivity of a liquid toner has been well established in the art as a measure of the effectiveness of a toner in developing electrophotographic images. A range of values from $1.0\times10^{-11}$ ohm/cm to $10.0\times10^{-11}$ ohm/cm has been disclosed as advantageous in U.S. Pat. No. 3,890,240. High conductivities generally indicate inefficient disposition of the charges on the toner particles and is seen in the low relationship between current density and toner deposited during development. Low conductivities indicate little or no charging of the toner particles and lead to very low development rates. The use of charge director compounds to ensure sufficient charge associated with each particle is a common practice. There has in recent times been a realization that even with the use of charge directors there can be much unwanted charge situated on charged species in solution in the carrier liquid. Such charge produces inefficiency, instability and inconsistency in the development.

Localization of the charges onto the toner particles ensures that there is substantially no migration of charge from those particles into the liquid, and the exclusion of other unwanted charge moieties from the liquid gives substantial improvements. As a measure of the required properties, we use the ratio between the conductivity of the carrier liquid as it appears in the liquid toner and the conductivity of the liquid toner as a whole. This ratio must be less than 0.6 preferably less than 0.4 and most preferably less than 0.3. Prior art toners examined have shown ratios much larger than this, in the region of 0.95.

Carrier Liquids

Carrier liquids used for the liquid toners of this invention are chosen from non-polar liquids, preferably hydrocarbons, which have a resistivity of at least $10^{11}$ ohm-cm and preferably at least $10^{13}$ ohm-cm, a dielectric constant less than 3.5 and a boiling point in the range 140° C. to 220° C. Aliphatic hydrocarbons such as hexane, cyclohexane, iso-octane, heptane, and isododecane, and commercially available mixtures such as Isopars TM G, H, K, and L (Exxon Chemical Company) are suitable. However, aromatic hydrocarbons, fluorocarbons, and silicone oils may also be used.

The following non-limiting examples further illustrate the present invention.

EXAMPLES

Preparation of Charge Controlling Resinous Dispersions Containing Acid Groups with a pka Value Less Than 4.5

1. Using vinylbenzoic acid (VBA), pka=4.2

A. Preparation of the stabilizer containing Vinylbenzoic Acid (VBA)

Into a 500 ml. 2-necked flask fitted with a thermometer, and a reflux condenser connected to a $N_2$ source, was introduced a mixture of 3.5 g of 4-vinylbenzoic acid (Aldrich Chemical Co. , 3 g of allyl methacrylate, 150 ml tetrahydrofuran and 150 ml ethylacetate. The mixture was stirred to dissolve the benzoic acid compound. Next was added 93.5 g of laurylmethacrylate. The flask was purged with $N_2$ and heated at 70° C. for 10 minutes. The flask was purged again with $N_2$ and 1 g of 2,2-azobisisobutyronitrile (AIBN) was added all at once and heated at 70° C. under a $N_2$ blanket. This was continued for a period of 8 hours. The resulting polymeric solution was cooled to room temperature and diluted with twice its volume with Isopar TM G and filtered to remove insoluble materials (About 125 mg of homopolymer of VBA acid remained on the filter paper). The clear filtered polymeric solution was further diluted with Isopar TM G to 4.1 liters and was subjected to distillation under reduced pressure until about 500 ml of the distillate was collected in the receiving flask. The distillate was mainly ethylacetate, tetrahydrofuran and Isopar TM G).

B. Preparation of the resinous dispersion containing VBA

The stabilizer solution of 1A above was heated to 80° C. under $N_2$ for 15 minutes. After purging with nitrogen for 10 minutes, 10 g of ethyl acrylate and 2 g of benzoyl peroxide were then added and heated at 80° C. under $N_2$ continuously for 3 hours. The solution was cooled to 70° C. 190 g of ethylacrylate was added containing 1.5 g of AIBN and the polymerization mixture was heated at 70° C. under $N_2$ for 20 hours. A white resin dispersion was obtained which was concentrated to 15% w/w by distilling a portion of the solvent under reduced pressure. The particle size of the particles was in the range of 205 nm+/−50 nm. A Coulter $N_4$ submicron particle size analyzer was used for the determination of the particle size.

2. Using 2-Methacryloyloxyethyl hydrogen phthalate (MHP), pka=3

A. Preparation of a graft stabilizer precursor containing MHP

Into a 500 ml 2-necked flask fitted with a thermometer, and a reflux condenser connected to a nitrogen source, was introduced a mixture of 6 g of MPH, 2 g of 2-vinyl-4,4-dimethylazlactone (VDM) (*Journal of Polymer Science*, Poly. Chem. Ed., vol. 22, No. 5, May 1984, pp. 1179–1186), 92 g of lauryl methacrylate and 200 g of ethyl acetate. The flask was purged with nitrogen and heated at 70° C. for 15 minutes. After purging again with nitrogen, 1 g of AIBN was added at once and heating at 70° C. was continued for 8 hours. A clear polymeric solution was obtained. An IR spectra of a dry film of the polymeric solution showed an azlactone carbonyl at 5.4 microns.

B. Preparation of graft copolymer stabilizer containing (MHP); Reaction of 2A above with 2-hydroxyethylmethacrylate (HEMA)

Ethyl acetate was replaced from the polymeric solution of 2A above with Isopar TM G by diluting 2A with an equal volume of Isopar TM G and distilling the ethyl acetate under reduced pressure. To the clear stabilizer solution in Isopar TM G was added 3 g of HEMA and 0.2 g of dodecylbenzene sulfonic acid (DBSA) and the mixture was stirred at room temperature overnight. The IR spectra of a dry film of the polymeric solution showed the disappearance of the azlactone carbonyl peak indicating the completion of the reaction of the azlactone with HEMA.

C. Preparation of the resinous dispersion containing MHP

The stabilizer solution of 2B above was diluted to 3.6 liters with Isopar TM G and heated under a nitrogen blanket at 70° C. for 15 minutes. After purging with nitrogen, a solution of 22 g of ethyl acrylate containing 3.5 g of AIBN was added and the stirred dispersion polymerization mixture was heated at 70° C. under a nitrogen atmosphere for 20 hours. A white resin dispersion was obtained which was concentrated to 15% w/w by distilling under reduced pressure. Particle size analysis indicated that the particle size range of the obtained resin dispersion is 135 nm±29 nm.

3. Using mono- (2-methacryloyloxyethyl)-succinic acid (MSA), pka<4.2

A. Preparation of a graft stabilizer precursor containing (MSA)

Into a 500 ml 2-necked flask fitted with a thermometer and a reflux condenser connected to a nitrogen source was introduced a mixture of 5 g of 2-hydroxyethylmethacrylate, 95 g of lauryl methacrylate and 240 g of ethylacetate. The solution was heated at 70° C. for 15 minutes under a nitrogen blanket. After purging with $N_2$, 1 g of AIBN was then added to this solution. The polymerization reaction was allowed to proceed while stirring at 70° C. for 8 hours. The ethyl acetate was replaced with Isopar TM G by distilling under reduced pressure.

B. Reacting the hydroxy groups of 3A above with succinic anhydride

To the thus obtained polymer solution of 3A above was added 4 g of succinic anhydride, 200 mg of p-toluene sulfonic acid monohydrate and 50 ml of toluene. The stirred reaction mixture was then allowed to react at 125° C. for 5 hours. It was cooled to room temperature and then filtered to remove unreacted succinic anhydride. 0.35 g of solids was collected which corresponded to the unreacted excess succinic anhydride. The clear just filtered polymer solution was returned to the reaction flask.

C. Preparing a graft copolymer stabilizer by reacting a fraction of the succinic acid groups of 3B with glycidyl methacrylate (GMA)

To the polymer solution of 3B above was added 100 mg of p-toluene sulfonic acid, 2 g of glycidylmethacrylate and 25 mg of hydroquinone. The reaction mixture was then stirred at 115° C. for 15 hours. An acid value indicated that about 70% of GMA has been reacted.

D. Preparation of a resinous dispersion containing mono-alkylsuccinic acid groups The resin dispersion of this example was prepared according to the procedure of Example 2C above except using the stabilizer of 3C instead of 2B. A resinous dispersion was obtained having particle size of 159 nm+/−45 nm with a solid contents of 14.8%.

4. Using 2-sulfoethylmethacrylate (SM), pKA less than 1.0

A. Preparation of the stabilizer containing (SM)

Into a 500 ml 2-necked flask fitted with a thermometer and a reflux condenser connected to a $N_2$ source was introduced a mixture of 4.5 g of 2-sulfoethylmethacrylate (Dow Chemical Co.), 3 g of allyl methacrylate, 92.5 g of lauryl methacrylate and 240 g of ethyl acetate. The reaction mixture was heated at 70° C. and the flask was purged with nitrogen. Then 1 g of AIBN was added and heating at 70° was continued for 8 hours under a nitrogen blanket. A clear and slightly amber-colored polymeric solution was obtained. The resulting polymeric solution was diluted with 4 liters of Isopar TM G and was subjected to distillation under reduced pressure until about 400 ml of the distillate was collected in the receiving flask.

B. Preparation of the resinous dispersion containing SM

The procedure of example 1B above was followed except for using the stabilizer of 4A above instead of the stabilizer of example 1A. A slightly colored resin dispersion was obtained which concentrated to 15% w/w by distilling a portion of the solvent under reduced pressure. The particle size of the resulting product was in the range of 201 nm+/−31 nm.

5. Reference Example

This example illustrates the preparation of a non-inventive resinous dispersion containing pendant organic acid groups with a pKA value greater than 4.5

A. Preparation of a non-inventive stabilizer precursor containing acid groups derived from 12-hydroxystearic acid (pKA=4.85)

Into a 500 ml 2-necked flask fitted with a thermometer and a reflux condenser connected to a nitrogen source was introduced a mixture of 80 g laurylmethacrylate, 8 g VDM, 220 g of Isopar TM G and 20 g of n-hexane. The flask was purged with nitrogen and heated at 70° C. under a nitrogen blanket for 15 minutes. After purging again with nitrogen, 0.8 g of AIBN was added and the stirred reaction mixture was heated under a blanket of nitrogen for 8 hours. A clear polymer solution was obtained. An IR spectra of a dry film showed an azlactone carbonyl at 5.4 micron.

B. Preparation of graft copolymer stabilizer containing stearic acid groups by reacting 5A above with HEMA and 12-hydroxystearic acid (HSA)

To the thus obtained polymer solution of 5A above was added 12 g HSA, 2 g of HEMA and 0.3 g of dodecylbenzene sulfonic acid (DBSA). The stirred reaction mixture was allowed to react at 65° C. After 6 hours, the heating element was removed and stirring was continued for another 14 hours. A clear polymeric solution was obtained. The IR spectra of a dry film of the polymeric solution showed the disappearance of the azlactone carbonyl peak indicating the completion of the reaction of the azlactone with HEMA and HSA.

C. Preparation of the resinous dispersion containing HSA

The resin dispersion of this example was prepared according to the procedure of Example 2C above using the graft stabilizer of reference example 5B. A white dispersion was obtained with a particle size of 119 nm+/−23 nm. It was concentrated under reduced pressure to 14.6% solids w/w.

Charge Stability of the Charge Controlling Resinous Dispersion

An experiment was conducted to study the stability of the charge controlling resinous dispersion as follows: A 0.5% resin dispersion of Example IB was titrated with zirconium neodecanoate and the conductivity was measured after 2 hours, 24 hours, and 24 days from the start of mixing. The same experiment was repeated except using only zirconium neodecanoate in Isopar TM G. The results of the conductivity measurements indicated that the conductivity of the zirconated resin dispersion at the higher levels of zirconium dropped considerably in a 24 hour period. However, after that period the conductivity remained constant for all the molar concentrations of zirconium. The conductivity of only Zr in Isopar TM G showed a continuous drop in the conductivity with time. It can be concluded from this experiment that the charge controlling resinous dispersion of this invention is very stable and does not deteriorate with time. Another conclusion is that simple metal soaps in the carrier liquid tend to separate out with time from the solvent system to form micelles. Consequently a degradation of the charge is evident.

Preparation of Liquid Developers

Commercial pigments were usually purified by a soxhlet extractor with ethyl alcohol to remove any contaminant which might interfere with the polarity of the charge controlling resinous dispersion. The alcohol was replaced with Isopar TM G by diluting the pigment with Isopar TM G and distilling the alcohol under reduced pressure. A mixture of the pigment in Isopar TM G and the charge controlling resinous dispersion was then dispersed by known dispersion techniques. The most preferred device was the Igarashi mill. Usually between 5–120 minutes of mechanical dispersion was sufficient to obtain a particle size between 0.1–1.0 micron. The preferred ratio of pigment to resinous polymer was 1:2 to 1:5 with most preferred being 1:2.5. A wide range of pigments and dyes may be used. The only criteria is that they are insoluble in the carrier liquid and are capable of being dispersed to a particle size below a micron in diameter.

Examples of preferred pigments are as follows:
Sunfast magenta
Sunfast blue (1282)
Benzidine yellow (All Sun Co.)
Quinacridone
Carbon black (Raven 1250)
Carbon black (Regal 300)
Perylene Green A set of four color liquid developers were prepared as outlined in the method above by milling the following ingredients for each toner: 300 g of 15% w/w of the resin dispersion of Example 1B in Isopar TM G, 7.56 g of 40% zirconium neodecanoate in mineral oil and 100 g of 18% cleaned pigment in Isopar TM G. The pigments and the particle size range of the produced liquid toner samples are summarized in Table I below.

TABLE I

| Toner Sample | Pigment | Particle Size, range (nm) |
|---|---|---|
| Sample-A | Metal Azo Red (Magenta) | 298 +/− 105 |
| Sample-B | Pthalocyanine (Cyan) | 200 +/− 60 |
| Sample-C | Bis Azo Yellow (Yellow) | 532 +/− 198 |
| Sample-D | Perylene Green + Quinacridone (Black) | 368 +/− 130 |

Preparation of a non-inventive reference toner (Sample-E) The pKA value of the acid groups of the resin polymer=the pKA value of the metal salt, 4.85)

For the purpose of comparison, a non-inventive reference toner (Sample E) was prepared in the same manner as was toner Sample A of Table I above except using 308.2 g of the resin dispersion of the reference Example 5C in place of the resin dispersion of Example 1B. The particle size diameter of the thus prepared toner was found to be in the range of 818 nm+/−296 nm.

It can be seen from Table I that the average particle diameter of each of the inventive toner Samples A, B, C, and D is much smaller than the average particle diameter of the non-inventive reference toner Sample E. Also, the particle size distribution of the inventive toner samples was smaller than the non-inventive sample toner particle size. Furthermore, the non-inventive toner Sample E was found to settle upon storage for one week while the toner samples (A-D) of Table I did not show any sedimentation when subjected for storage for more than three months (which is the period of testing). The prepared liquid toners according to the present invention were found to have small and uniform particle size diameters and were stable towards sedimentation.

Preparation of an inventive toner Sample F the pKA value of the acid groups of the resin dispersion=3

A yellow toner was prepared in the same manner as in toner Sample C of Table I above except suing 300 g of the resinous dispersion of Example 3C in place of the resinous dispersion of Example 1B and 6.8 g of Zr neodecanoate instead of 7.56 g. The particle size diameter was found to be in the range of 381 nm+/−138 nm.

Measurements of the electrical properties of the liquid developers of this invention The characterization of colloidal particles by means of electrophoretic analysis plays an important role in predicting the quality of liquid developers. Important particle parameters including conductivity, mobility (zeta potential), and electrical charge can be experimentally determined as follows:

1. Conductivity Measurement

Conductivity is defined as current density (measured as coulombs/second/cm$^2$) per unit applied field (volt/cm). Experimentally, the initial conductivity ($k_0$) is calculated from the initial current ($i_0$) as:

$$k_0=i_0/(E_0A)$$

Where:

$E_0$ is the applied field and A is the electrode surface area.

Conductivity is also given by:

$$k_0=\text{sum}_i\, n_i\, q_i\, m$$

Where:

$n_i$, $q_i$, $m_i$ are the number, charge and mobility respectively of the ith ionic species.

Conductivity then is the sum of the products of the concentrations of the contributing charged species multiplied by their respective velocities per unit field. A high conductivity value for a toner dispersion could be due to the high mobility and/or concentration of any charged species present in the liquid. Therefore, a reliable conductivity measurement must be associated with other characteristics such as particle mobilities or charge per unit volume.

2. Particle Mobility Measurement (Zeta potential)

The liquid toner particle mobility was determined experimentally using a parallel plate capacitor type arrangement. The capacitor plate area is large compared to the distance between plates so that an applied voltage results in a uniform electrical field (E=V/d; V=applied voltage; d=plate separation) applied to a dispersion when placed between the plates. The measurement consisted of monitoring the transmission optical density (TOD) of deposited toner as a function of deposition time. The toner is electrically deposited on indium tin oxide coated glass and the TOD is measured with a Macbeth TR 524 optical densitometer. The fraction of deposited toner (f) relative to the total toner present increases with deposition time. The rate of toner deposition or mobility is determined by plotting ln(1/1−f) with time. The resultant linear plot gives a slope time constant to $t_c$ and the mobility m is determined from the equation:

$$m=(d/t_c)/(v/d)$$

The zeta potential z is directly related to the mobility by:

$$z=3nm/2ee_0$$

Where n is the liquid viscosity (n=0.0101 poise at 25° C.), $e_0$ is the electric permitivity and e is the dielectric constant of Isopar TM G (e=2.003).

Working strength liquid developers (0.5% solids in Isopar TM G) were made in the same manner as described in the toner preparation section and the toner samples were evaluated using a conductivity cell comprising two plane parallel electrodes separated by Mylar ® or teflon spacer to obtain 0.26 cm gap. Voltages were derived from a Kepco Model BOP 1000M bipolar operational power supply/amplifier while currents monitored with a Keithly 616 digital electrometer were recorded on an Anologue Devices Macsym 150 computer for subsequent data processing. The optical densities of toner deposits on transparent (Indium-Tin oxide coated glass) electrodes were recorded using either a Perkin Elmer Model 330 spectrophotometer or, more usually, a Macbeth Model TR524 transmission densitometer.

In Table II below the conductivity, particle mobility (Zeta potential) and reflection optical density (ROD) measurements of toner samples A, B, C, D, E, and F are listed. The ROD was measured after one second of development time at 1000 volts field across the cell electrodes.

TABLE II

| Toner sample (COLOR) | Conductivity, $10^{-11}$/ohm-cm | Mobility, $10^{-5}$ cm$^2$/vosec | Zeta mV/V, sec. | ROD at 1000 V, 1 sec. |
|---|---|---|---|---|
| A (magenta) | 5.2 | 1.4 | 119.6 | 1.3 |
| B (cyan) | 4.2 | 1.24 | 105.9 | 1.92 |
| C (yellow) | 2.6 | 1.2 | 102.5 | 1.38 |
| D (black) | 3.42 | 1.42 | 121.3 | 1.92 |
| F (yellow) | 4.3 | 1.81 | 154.6 | 2.2 |
| E (magenta)* | 1.92 | 0.52 | 44.4 | 0.6 |

*Non-inventive sample for comparison

It can be seen from Table II that the zeta potentials of the toners of this invention (Samples, A, B, C, D, and F) is in the range of 100 to 200 mV which is much higher than the zeta potential of the non-inventive toner Sample E. Toner Samples A, B, C, D, and F of this invention are derived from resin dispersions containing acid groups with pKA values less than 4.5 while the toner of the non-inventive reference Sample E is derived from a resin dispersion containing acid groups with a pKA value equal to 4.85. The higher zeta potentials obtained with the toners of the present invention resulted in much higher reflectance optical density (ROD) values and superior dispersion stability compared to the non-inventive liquid toner Sample E.

Example of Application of Inventive Toners to Electrophotographic Imaging

The toners of present invention were used for the development of latent electrostatic images on an organic photoconduct as disclosed in U.S. Pat. No. 4,361,637. The photoreceptor was topcoated with a release layer comprising a 1.5% solution of Syl-Off TM 23 (a silicone polymer available from Dow Corning Corp.) in heptane, and dried.

The photoreceptor was positively charged, exposed to a first half-time separation image with a suitable imaging light and developed with the magenta toner A using an electrode spaced 510 microns away for a dwell time of 1 second with a toner flow rate of 500 ml/min. The electrode was electrically biased to 300 volts to obtain the required density without perceptible background. The excess carrier liquid was dried from the toner image. The magenta imaged photoreceptor was recharged, exposed to a second half-tone separation image with a suitable imaging light and developed with the yellow toner C under the same conditions as for the first image and dried. Again the photoreceptor was charged, exposed to a third half-tone separation image with a suitable imaging light source, developed with the cyan toner B, and dried.

A receptor sheet comprising a sheet of 3 mil phototypesetting paper coated with 10% titania pigment dispersed in Primacor TM 4983 to a thickness of 2 mils was laminated against the photoreceptor with a roller pressure of 5 pounds/linear inch and a temperature of 110° C. at the surface. Upon separating the paper receptor, the complete image was found to be transferred and fixed to the paper surface without distortion.

The finished full color image showed excellent half-tone dot reproduction at 150 line screen of from 3% to 97% dots. The yellow, cyan and magenta toners produced excellent image densities of 1.4 for each color and the black toner D produced an image density of 1.95. The toners also gave excellent overprinting with trapping of between 85–100% without loss of detail of the individual dot. The background was very clean and there was no evidence of unwanted toner deposit in the previously toned areas. The final image was found to be rub resistant and non-blocking.

Reasonable modifications and variations are possible from the foregoing disclosure without departing from either the spirit or scope of the present invention as defined in the claims.

What is claimed:

1. A liquid toner for developing an electrostatic image comprising copolymer particles dispersed in a non-polar carrier liquid, said copolymer particles comprising a thermoplastic resinous core substantially insoluble in said carrier liquid, and chemically anchored to said core a copolymeric steric stabilizer soluble in said carrier liquid and having chemically bonded thereto moieties containing organic acids having a pKa less than 4.5 to which acids are chemically bonded metal soap compounds derived from organic acids with a pKa of greater than 4.5, said metal soap compounds imparting a positive charge to said liquid toner.

2. A liquid toner as recited in claim 1 wherein a ratio of conductivities of said carrier liquid in said liquid toner and of said liquid toner alone is less than 0.6.

3. A liquid toner as recited in claim 1 wherein the carrier liquid comprises a hydrocarbon liquid having a boiling point in the range 140° C. to 220° C., a resistivity of more than $10^{11}$ ohm-cm, and a dielectric constant less than 3.5.

4. A liquid toner as recited in claim 3 wherein said carrier liquid has a resistivity of at least $10^{13}$ ohm-cm.

5. A liquid toner as recited in claim 1 further comprising colorant particles which are selected from the group consisting of:

Sunfast magenta,
Sunfast blue,
Benzidine yellow,
Quinacridone, and
Carbon black,
Perylene green.

6. A liquid toner as recited in claim 1 wherein said resinous core is derived from monomers selected from the group consisting of ethylacrylate, methylacrylate, and vinylacetate.

7. A liquid toner as recited in claim 1 wherein said resinous core has a Tg of less than 25° C.

8. A liquid toner as recited in claim 7 wherein a weight ratio of the stablilizer to a combination of the core and the stabilizer is in a range of 5% to 60%.

9. A liquid toner as recited in claim 1 wherein said resinous core has a Tg in a range of 25° C. to 105° C. and a weight ratio of the stablilizer to a combination of the core and the stabilizer is in a corresponding range of 20% to 80%.

10. A liquid toner as recited in claim 1 wherein said stabilizer further comprises an anchoring component and a solubilizing component soluble in said carrier liquid, said anchoring component forming a covalent link from said stabilizer to said core.

11. A liquid toner as recited in claim 10 wherein said anchoring component comprises an ethylenically unsaturated moiety capable of forming a copolymer.

12. A liquid toner as recited in claim 11 wherein said solubilizing component is derived from a group of monomers and polymers containing at least one solubilizing moiety chosen from the group consisting of: octadecyl methacrylate, lauryl methacrylate, 2-ethylhexylacrylate, poly(12-hydroxystearic acid), and 0.5–0.6 mole % methacryloxypropylmethyl polydimethylsiloxane, which is trimethylsiloxy terminated.

13. A liquid toner as recited in claim 10 wherein said anchoring component comprises a moiety derived from a monomer chosen from the group consisting of a) an adduct of an alkenylazlactone with an unsaturated nucleophile containing at least one substituent chosen from the group consisting of hydroxy, amino, and mercaptan;
b) an adduct of a glycidylmethacrylate with a reactant chosen from acrylic acid and methacrylic acid; and
c) allylmethacrylate.

14. A liquid toner as recited in claim 13 wherein said moiety is derived from a monomer chosen from the group consisting of adducts of: (a) an alkenylazlactone of the structure:

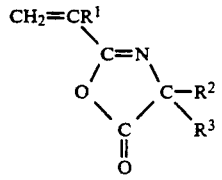

where $R^1$=H, alkyl, or $C_1$ to $C_5$; and $R^2$ and $R^3$ are independently lower alkyl of $C_1$ to $C_8$, and (b) an unsaturated nucleophile chosen from the group consisting of:

2-hydroxyethylmethacrylate,
3-hydroxypropylmethacrylate,
2-hydroxyethylacrylate,
pentaerythritol triacrylate,
4-hyroxybutylvinylether,
9-octadecen-1-ol,
cinnamyl alcohol, allyl mercaptan, and
methallylamine.

15. A liquid toner as recited in claim 14 wherein the alkenylazlactone is 2-vinyl-4,4-dimethylazlactone.

16. A liquid toner as recited in claim 1 wherein said moieties containing organic acids of pKa less than 4.5 contain acidic functional groups chosen from the group consisting of:

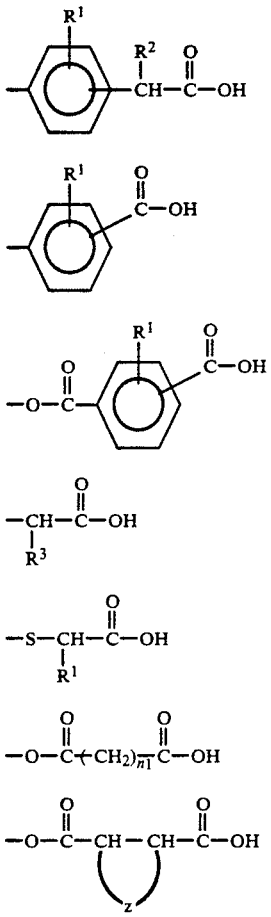

wherein $R_1$ and $R_2$ each individually represent hydrogen, alkyl, halogen, hydroxy, alkoxy, nitrile, amido, carboxyl, nitro, thionyl, phenoxy, sulfo, heterocyclic, sulfenyl, mercapto or carbonyl;

$R_3$ is an electron withdrawing group selected from nitro, nitrile, halogen, and carbonyl;

$n_1$ is an integer from 1-3;

z is $-(CH_2)_{n2}-$ $n_2$ is an integer from 1-5.

17. A liquid toner as recited in claim 1 wherein the metal soap compound is chosen from the group consisting of the salt of a fatty acid with a metal selected from the group consisting of Al, Ca, Co, Cr, Fe, Zn, and Zr.

18. A liquid toner as recited in claim 17 wherein the metal is zirconium.

19. A liquid toner as recited in claim 18 wherein the metal soap is zirconium neodecanoate.

20. A method of making a liquid toner comprising the steps of

A. preparing a comonomeric stablizer precursor by free radical catalyzed polymerization of three ethylenically unsaturated monomers, one selected from each of groups I, II, and III, said group I comprising an alkenylazlactone, a glycidylmethacrylate, methacrylic acid, and allylmethacrylate, said group II comprising octadecyl methacrylate, lauryl methacrylate, 2-ethylhexylacrylate, poly(12-hydroxystearic acid), and a monomer of 0.5-0.6 mole % methacryloxypropylmethyl polydimethylsiloxane which is trimethylsiloxy terminated; and and said group III comprising moieties containing organic acids having a pKa of less than 4.5, B. carrying out reactions on said group I comonomer selected from:

i) condensing said azlactone moiety with an ethylenically unsaturated nucleophile chosen from the group containing a reactive group chosen from hydroxyl, amino, and mercaptan;

ii) condensing said glycidyl moiety with a reactant chosen from acrylic acid and methacrylic acid;

iii) condensing said acrylic acid moiety with glycidylmethacrylate; and iv) carrying out no reaction with the moiety derived from said allylmethacylate;

C. preparing a latex by copolymerizing the stabilizer precursor from the reaction of step B above in an aliphatic hydrocarbon solvent with a comonomer selected from the group consisting of: ethylacrylate, methylacrylate, and vinylacetate, D. adding the latex of step C above to a hot solution in said aliphatic hydrocarbon of a metal soap selected from the group consisting of the salt of a fatty acid having a pKa of greater than 4.5 with a metal selected from the group consisting of Al, Ca, Co, Cr, Fe, Zn, and Zr; and E. dispersing a colorant in the latex of step D.

21. A method of making a liquid toner as recited in claim 20 wherein the free radical polymerization catalyst used in step (A) is azobisisobutryonitrile.

22. A method of making a liquid toner as recited in claim 20 wherein the condensation recited in step B(i) is acid catalyzed.

23. A method of making a liquid toner as recited in claim 22 wherein the acidic catalyst employed in said step B(i) is chosen from the group consisting of:

stearyl acid phosphate;
methane sulfonic acid;
substituted or unsubstituted p-toluene sulfonic acids;
dibutyl tin oxide;
a calcium soap;
2-ethylhexanoate;
a chromium soap;
triphenylphosphine; and
triphenylantimony.

24. A method of making a liquid toner as recited in claim 20 wherein said ethylenically unsaturated nucleophile is chosen from the group consisting of 2-hydroxyethylmethacrylate,
3-hydroxypropylmethacrylate,
2-hydroxyethylacrylate,
pentaerythritol triacrylate,
4-hyroxybutylvinylether,
9-octadecen-1-ol,
cinnamyl alcohol,
allyl mercaptan, and
methallylamine.

25. A liquid toner for use in developing an electrostatic image comprising an electrically insulating nonpolar carrier liquid having dispersed therein toner particles comprising pigment particles having on their exterior surfaces polymer particles, said polymer particles having positive charge carrying metal soap compounds derived from organic acids with a pKa greater than 4.5 chemically bonded to the surface of said polymer particles by way of organic acid containing moieties which have a pKa of less than 4.5.

26. The toner of claim 25 wherein said polymer particles comprise a liquid, gel or solid.

27. The toner of claim 26 wherein the weight proportion of polymer particles to pigment is between 3:2 and 20:1.

28. The toner of claim 27 wherein the weight proportion of polymer particles to pigment is between 3.5: and 15:1.

29. The toner of claim 25 wherein said metal soap is derived from an organic acid which has a pKa value of from 4.6 to 4.9.

30. The toner of claim 25 wherein said organic acid has a pKa value of from −1 to 4.25.

* * * * *